US010900647B2

(12) United States Patent
Cacciabeve

(10) Patent No.: US 10,900,647 B2
(45) **Date of Patent: *Jan. 26, 2021**

(54) PORTABLE LIGHT

(71) Applicant: Walter R. Tucker Enterprises, Ltd., Deposit, NY (US)

(72) Inventor: Robert Cacciabeve, Boonton, NJ (US)

(73) Assignee: Walter R. Tucker Enterprises, Ltd., Deposit, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/860,590

(22) Filed: Apr. 28, 2020

(65) Prior Publication Data

US 2020/0256549 A1 Aug. 13, 2020

Related U.S. Application Data

(63) Continuation of application No. 16/426,382, filed on May 30, 2019, now Pat. No. 10,677,431, which is a continuation-in-part of application No. 29/665,892, filed on Oct. 8, 2018, now Pat. No. Des. 871,636, and a continuation-in-part of application No. 29/665,881, filed on Oct. 8, 2018, now Pat. No. Des. 871,257.

(60) Provisional application No. 62/743,327, filed on Oct. 9, 2018.

(51) Int. Cl.

| | |
|---|---|
| ***F21V 21/14*** | (2006.01) |
| ***F21L 4/02*** | (2006.01) |
| ***F21L 4/08*** | (2006.01) |
| ***F21V 21/096*** | (2006.01) |
| ***F21V 21/26*** | (2006.01) |
| ***F21Y 115/10*** | (2016.01) |

(52) U.S. Cl.

CPC ..... *F21V 21/145* (2013.01); *F21L 4/02* (2013.01); *F21L 4/08* (2013.01); *F21V 21/0965* (2013.01); *F21V 21/26* (2013.01); *F21Y 2115/10* (2016.08)

(58) Field of Classification Search

CPC ..... F21V 21/145; F21V 21/26; F21V 21/30; F21L 4/02; F21L 4/08; A44C 15/0015

See application file for complete search history.

(56) References Cited

U.S. PATENT DOCUMENTS

| | | | | | |
|---|---|---|---|---|---|
| 5,268,826 | A * | 12/1993 | Greene | F21L 15/08 | 362/103 |
| 5,385,500 | A * | 1/1995 | Schmidt | A63H 3/006 | 362/189 |
| 5,707,137 | A * | 1/1998 | Hon | F21L 4/04 | 362/183 |
| 5,717,276 | A * | 2/1998 | Hsu | F21L 15/06 | 313/318.01 |
| 6,004,004 | A * | 12/1999 | Altman | F21V 21/32 | 362/184 |
| 8,210,704 | B1 * | 7/2012 | Parsons | F21L 2/00 | 362/108 |
| 9,534,752 | B1 * | 1/2017 | Mishan | F21V 21/145 | |

(Continued)

*Primary Examiner* — William N Harris
(74) *Attorney, Agent, or Firm* — Breiner & Breiner, L.L.C.

(57) ABSTRACT

A portable neck light for wearing on a user's neck is disclosed having a neck member adapted to fit around a user's neck, body members on each side of the neck member having a light source, a movable member between each end of the neck member and each body member allowing for the adjustment of each light source independently of the other, a power source and an on/off switch.

20 Claims, 15 Drawing Sheets

(56) References Cited

U.S. PATENT DOCUMENTS

| | | | | |
|---|---|---|---|---|
| 2006/0176680 | A1* | 8/2006 | Bretz | F21L 2/00 362/108 |
| 2017/0102131 | A1* | 4/2017 | Chen | F21V 23/0407 |
| 2017/0138585 | A1* | 5/2017 | Korenek | F21V 17/107 |
| 2018/0231234 | A1* | 8/2018 | Bian | F21L 4/02 |

* cited by examiner

PORTABLE LIGHT

RELATED APPLICATIONS

This application is a continuation of U.S. application Ser. No. 16/426,382, filed May 30, 2019, entitled "Portable Light," which application claims benefit of U.S. Provisional Application Ser. No. 62/743,327, filed Oct. 9, 2018, entitled "Portable Light," and is a continuation-in-part of U.S. application Ser. No. 29/665,892, filed Oct. 8, 2018, entitled "Portable Light," and is a continuation-in-part of U.S. application Ser. No. 29/665,881, filed Oct. 8, 2018, entitled "Portable Light," which applications are incorporated herein by reference in their entireties.

FIELD OF THE INVENTION

The present invention relates to a portable light. More particularly, the invention relates to a portable neck light.

BACKGROUND OF THE INVENTION

Portable lights are known for use in various situations, including working on an automobile, working in the home and recreational uses. In such instances, there may not be an adequate amount of light; the user may require hands free lighting; the user may need to focus the light on the specific area being worked on; or similar issues.

Various types of portable lights are known in the art. While these devices may provide one or more of the desired attributes, including as set forth above, these devices have various shortcomings and may not meet the needs of a user of a portable light. These and other shortcomings of the known portable lights are addressed by the present invention.

SUMMARY OF THE INVENTION

A primary object of the present invention is to provide a portable light which may be worn on a user's neck.

Another primary object of the invention is to provide a portable light which is wearable and provides hands free lighting for work, recreation or other activities.

Another primary object of the invention is to provide a portable light which may fit around a user's neck, resting comfortably against the user's neck.

Another primary object of the invention is to provide a portable neck light having two light sources, one on each side of the neck.

Another primary object of the invention is to provide a portable neck light having a LED light source on each side of the user's neck and providing up to 300 lumens per light source.

Another primary object of the invention is to provide a portable light wearable around a user's neck with a light source on each side which may be independently adjustable on an up and down axis to direct illumination of light as required by the user.

Another primary object of the invention is to provide a portable light wearable around a user's neck with a light source on each side which light sources may be removeable from the portable light and function as a hand held light.

Another primary object of the invention is to provide a portable light powered by alkaline batteries.

Another primary object of the invention is to provide a portable light powered by rechargeable batteries.

Another primary object of the invention is to provide a portable light wearable around a user's neck made of a semirigid plastic such as ABS (acrylonitrile butadiene styrene) plastic. The neck member of the portable light may be flexible allowing the portable neck light to be pulled outward when placing the light around a user's neck and may contract once on a user's neck to rest snuggly and comfortably on the user's neck.

Another primary object of the invention is to provide a portable neck light having a USB port and a battery charge indicator.

The portable light of the invention comprises a neck member adapted to fit around a user's neck, body members on each side of the neck member having a light source, a movable member between each end of the neck member and each body member allowing for the adjustment of each light source independently of the other, a power source and an on/off switch.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers.

Referring to the drawings.

DETAILED DESCRIPTION OF THE PREFERRED EMBODIMENTS

Figure 1:
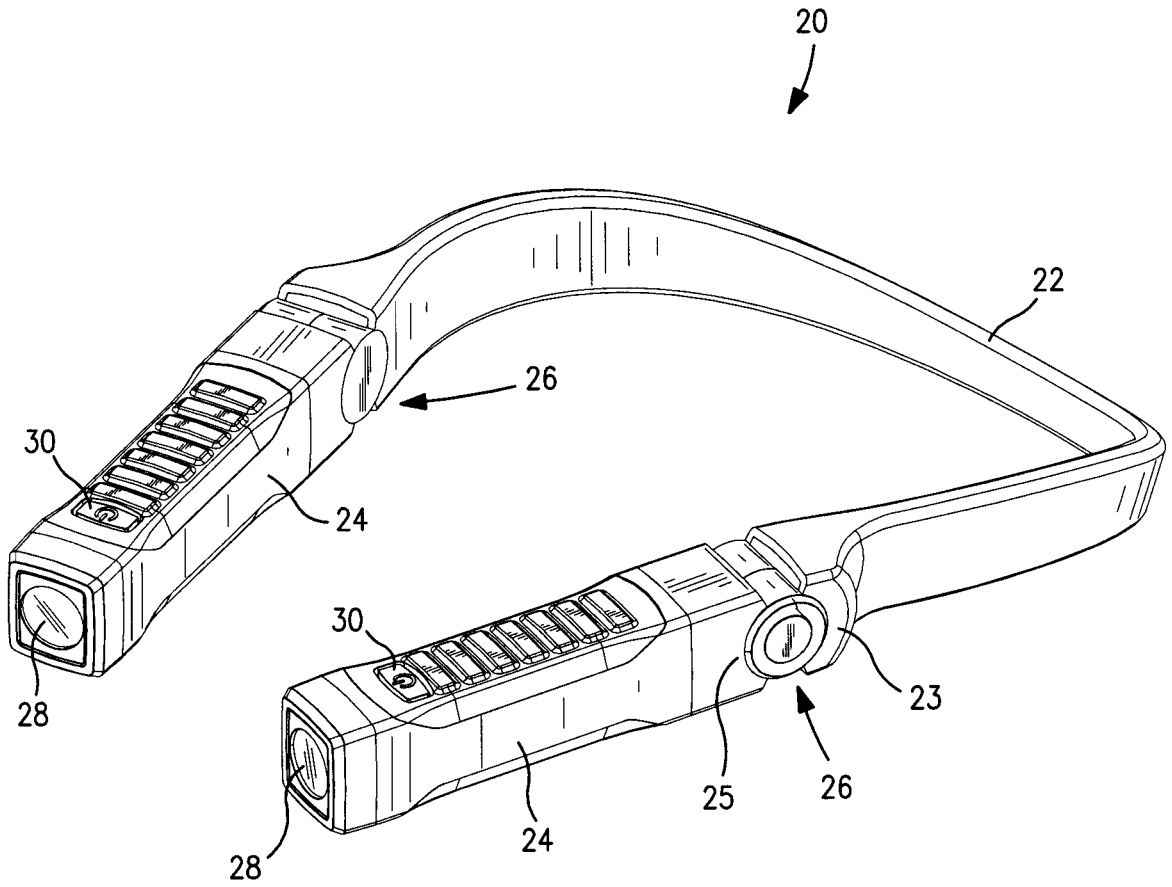
FIG. 1 is a perspective view of a first embodiment of the portable light.
Figure 3:
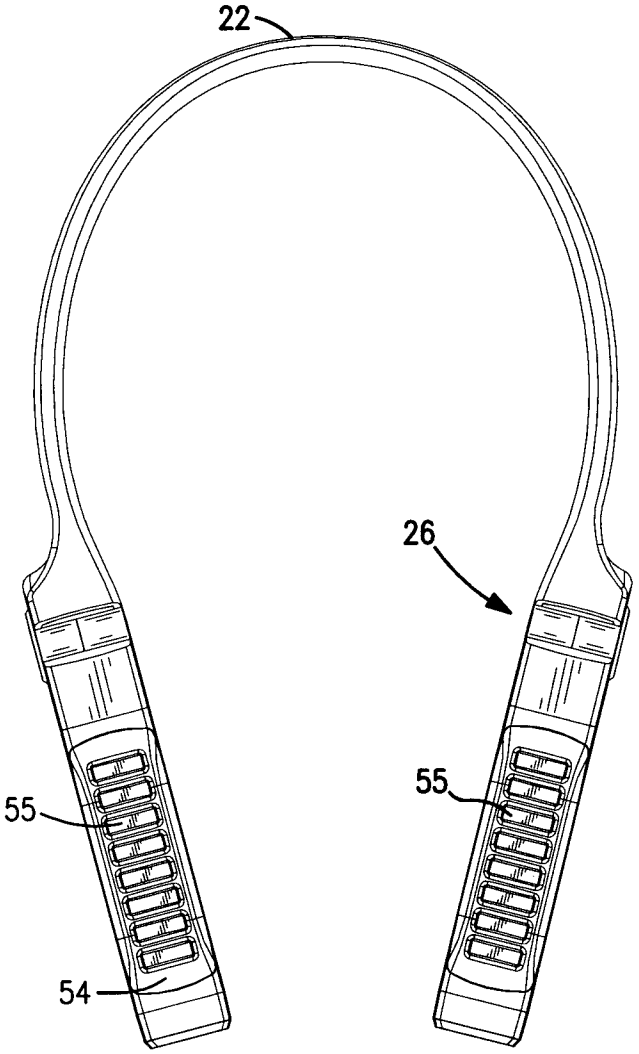
FIG. 3 is a bottom view of the portable light of FIG. 1.
Figure 2:
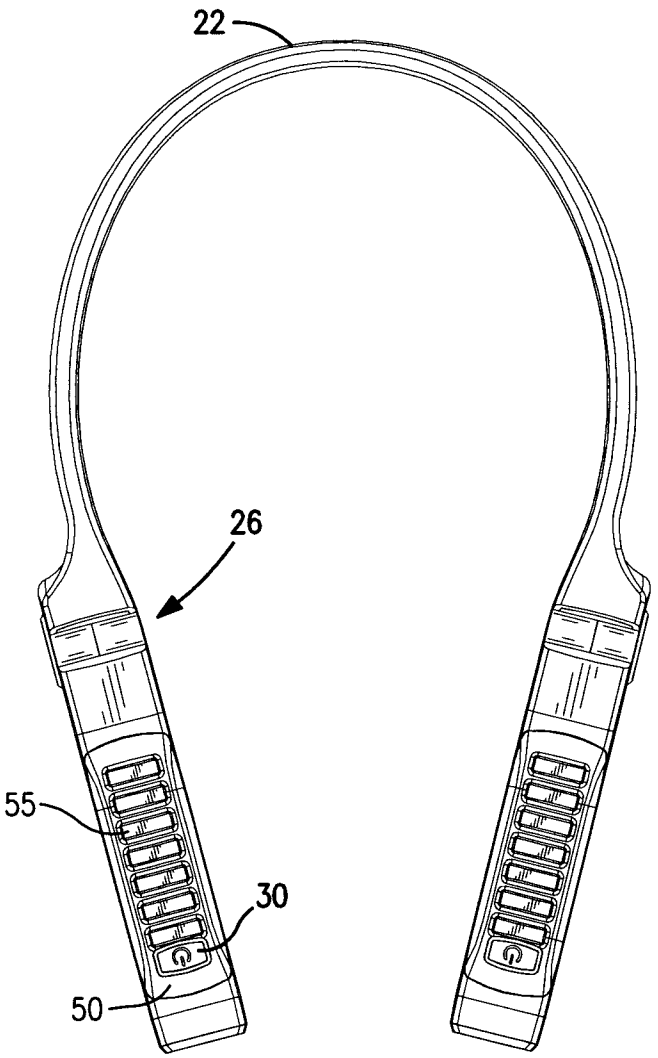
FIG. 2 is a top view of the portable light of FIG. 1.
Figure 6:
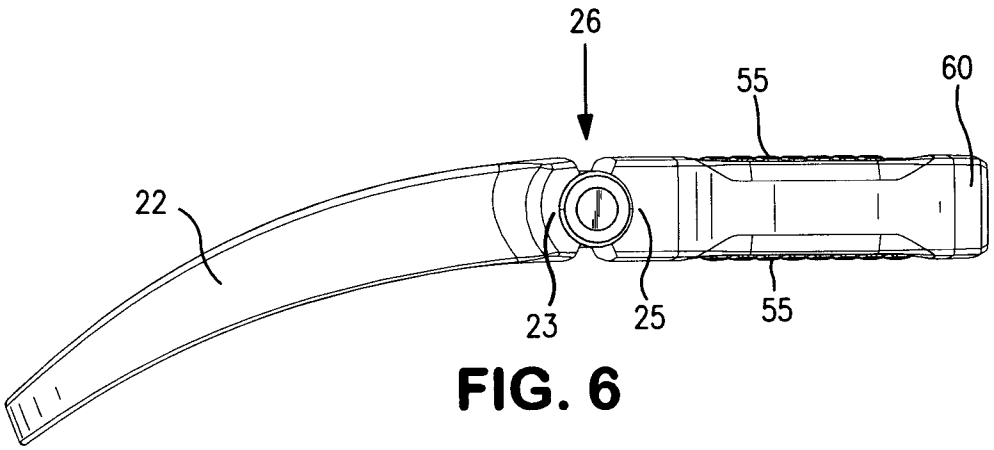
FIG. 6 is a side view of the portable light of FIG. 1.
Figure 4:
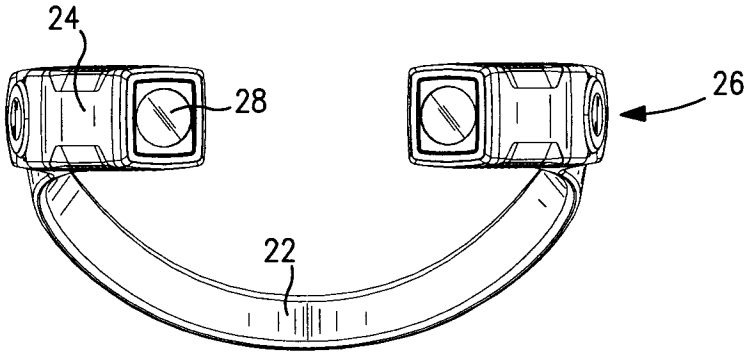
FIG. 4 is a front view of the portable light of FIG. 1.
Figure 5:
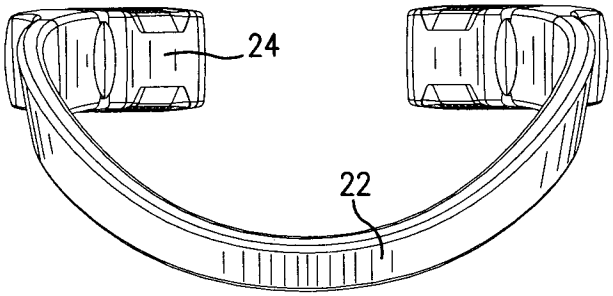
FIG. 5 is a rear view of the portable light of FIG. 1.

The present invention is directed to a portable light. More specifically, the present invention is directed to a portable light which may be wearable around a user's neck and includes on each side thereof a light source to provide the necessary illumination to an area of interest such as in an automotive garage or a work area in the home or for recreational purposes such as camping or reading. The portable light of the present invention includes a neck member adapted to fit around a user's neck, body members on each side of the neck member having a light source, a movable member between the neck member and each body member allowing for the adjustment of each light source independently of the other, a power source and an on/off switch.

FIGS. 1-8 show a first embodiment of the portable neck light invention; FIGS. 9-16 show a second embodiment of the portable neck light invention; and FIGS. 17-24 show a third embodiment of the portable neck light invention.

Referring to FIGS. 1-8, there is shown a portable light 20. The portable light 20 includes a neck member 22, body members 24, ratchet members 26, light sources 28 and switches 30. The portable light 20 will now be discussed in further detail.

Figure 7:
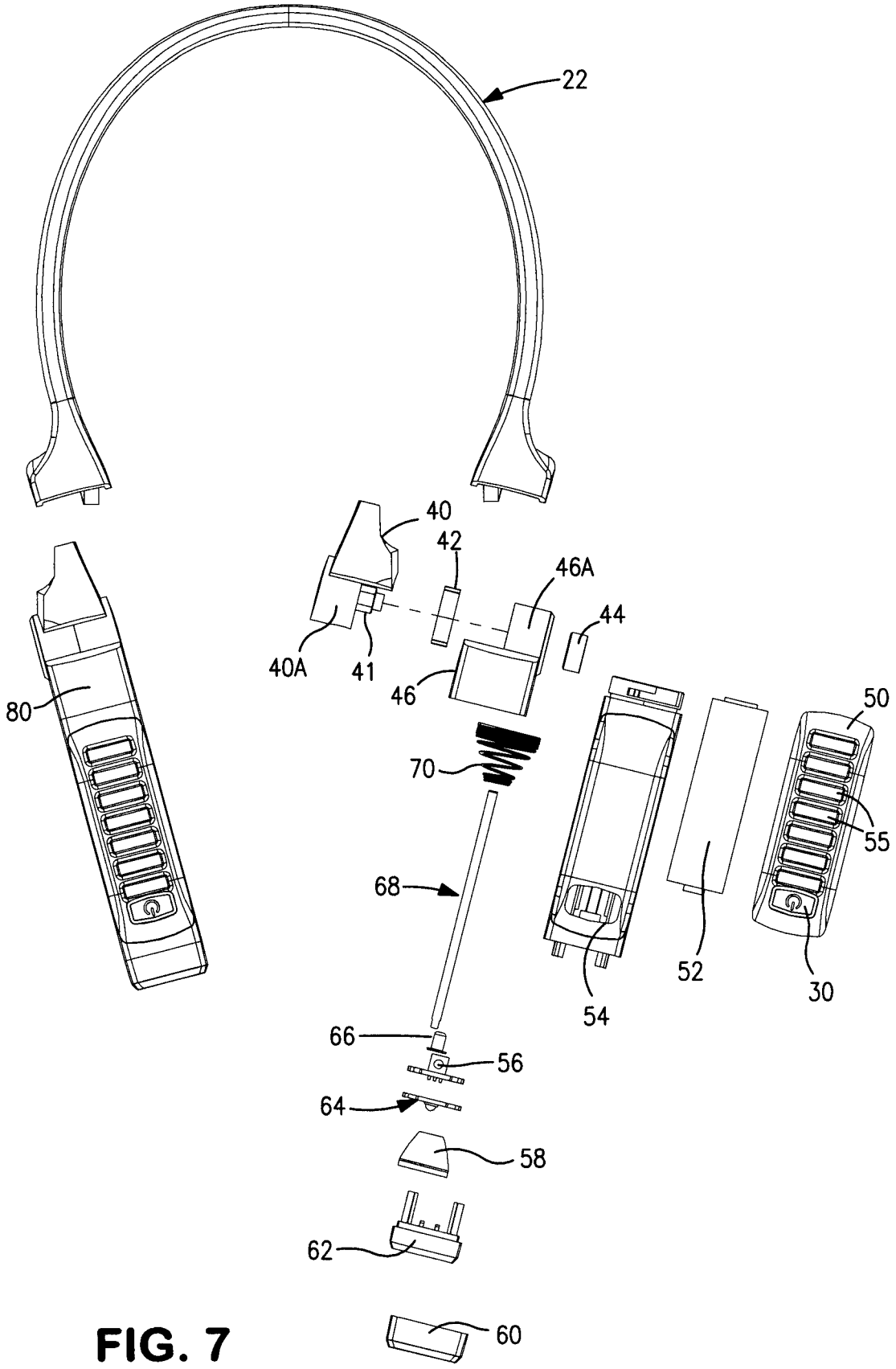
FIG. 7 is an exploded view of the portable light of FIG. 1.

Referring to FIG. 7, there is shown an exploded view of the portable light 20 and includes components of the portable light 20 as follows:

#22 Neck Member
#40 Ratchet Body (Gear Cap)
#42 Ratchet Screw Gear
#44 Ratchet Screw Cover
#46 Body Member End (Left Tail)
#50 Body Member Molded Body Top
#52 Battery
#54 Body Member Molded Body Bottom
#56 PCB Master
#58 Reflector
#60 Lens Cap
#62 Lens
#64 LED PCB
#66 Spacer
#68 Conductor Plate
#70 Spring
#80 RIGHT SIDE (40-70 substantially the same)

The various components of the portable light 20 will now be discussed in further detail. Neck member 22 fits around a user's neck and may rest on the shirt collar of the user or fit comfortably around the neck of the user. The neck member of the portable light may be flexible, made of ABS plastic, allowing the portable neck light to be pulled outward when placing the light around a user's neck and may contract once on a user's neck to rest snuggly and comfortably on the user's neck. Each body member 24 may include an on/off switch 30 and the lighting components to independently turn off each light source. The body 24 is a molded ABS plastic and includes a body top 50, a body bottom 54 and body end (left tail) 46 providing for an integral body 24. The top and bottom pieces 50 and 54 of body 24 may include ribs 55 for gripping and preferably made of a resilient material. Body 24 includes a body end piece 46 upon which the main portions 50 and 54 of the body 24 may rotate by a tongue and groove locking member to access the battery 52. Inside body 24 are a power source, e.g. an alkaline battery 52, and operating component 56, e.g. a printed circuit board (PCB). Body 24 further includes the lighting components including an LED PCB light source 64, lens cap 60, lens 62, reflector 58, spacer 66, conductor plate 68 and spring 70. The switch 30 and operating components may provide for two or more operating modes, e.g. on/off; or with high and low illumination and off; or on with multiple degrees of illumination and off.

Figure 8A:
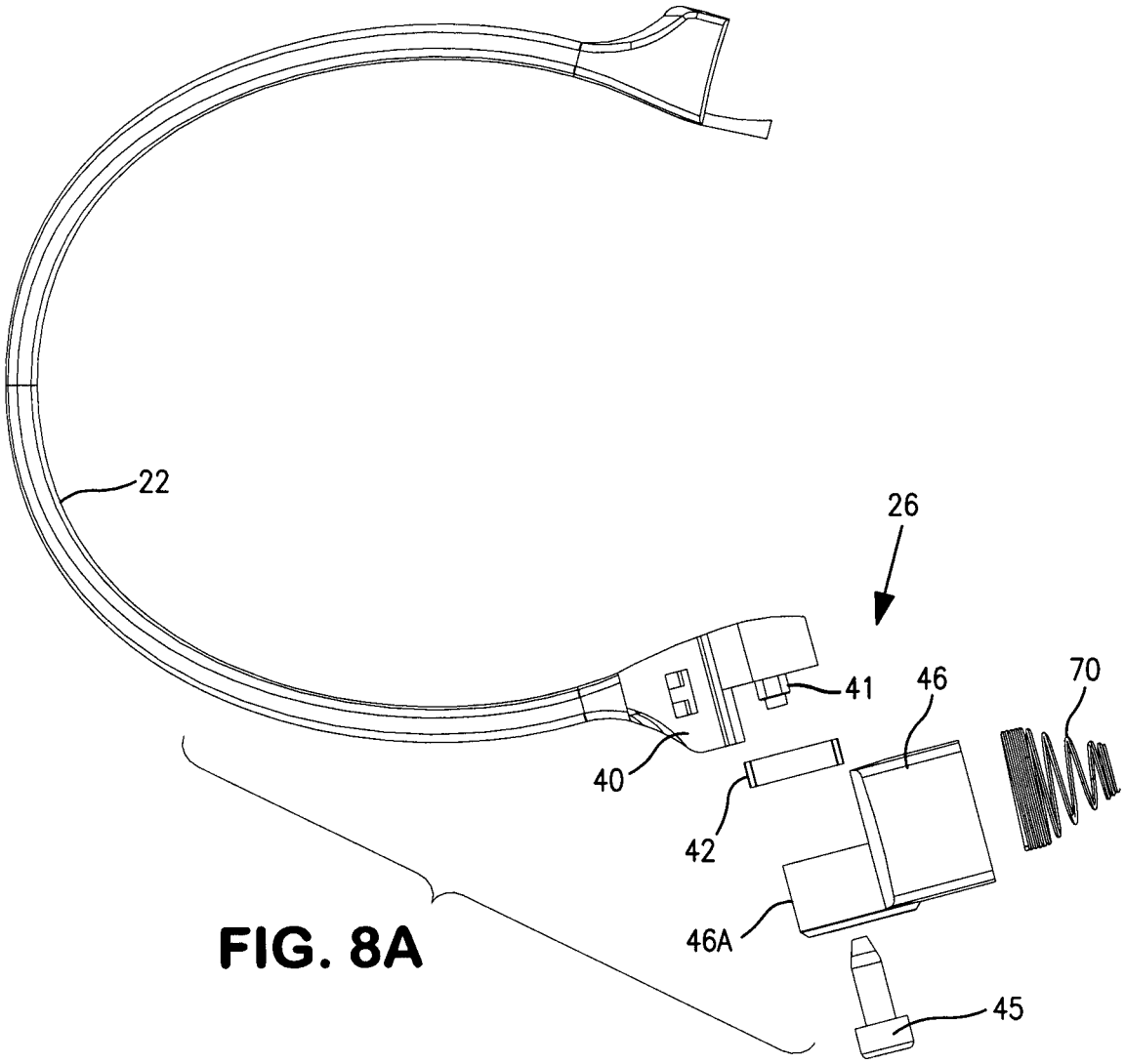
FIG. 8A shows the light components with respect to the ratchet member of the portable light of FIG. 1.
Figure 8B:
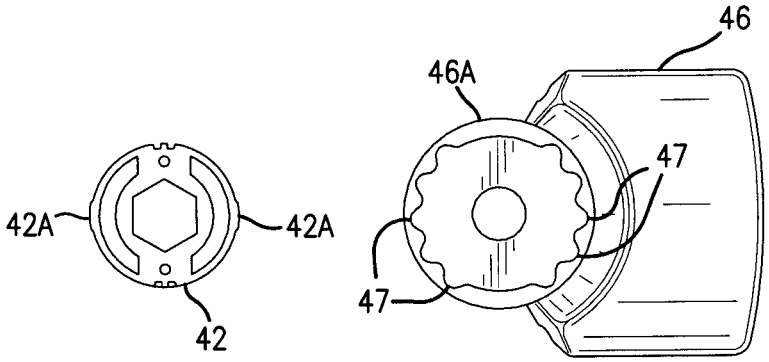
FIG. 8B is a detailed enlarged view of a part of the housing for the ratchet member and the screw gear of the portable light of FIG. 1.

Referring, for example, to FIGS. 1, 7 and 8, the ratchet member 26 includes a ratchet body 40 which mates with body end 46, and which is between neck member 22 and body member 24 and is generally cylindrical in shape. Neck member 22 with ratchet body 40 provide for a C-shaped end piece 23 and body member 24 with body end 46 provide for a C-shaped end piece 25. The ratchet member 26 allows body member 24 to rotate up and down on neck piece 22 for the user to focus the light source.

The ratchet member 26 includes a gear assembly which allows the light body 24 to be adjusted up and down in relation to neck piece 22, preferably to an angle of about 70 degrees, although the invention is not limited thereto. Preferably, the ratchet member 26 comprises a ratchet body 40, a ratchet screw gear 42, a ratchet screw cover 44, a screw 45 and body end 46. The ratchet body 40 includes a cylindrical portion 40A and body end 46 includes a cylindrical portion 46A, each of which mates to form the cylindrical shape of the ratchet member 26. There are detents 47 on the inner cylindrical wall of body end 46 which interact with screw gear members 42A of screw gear 42. Screw gear 42 fits on shaft 41 of ratchet body 40, as shown, for example, in FIGS. 7 and 8. Ratchet screw cover 44 is for aesthetics and covers screw 45. The ratchet member 26 allows body 24 to move to different fixed positions by movement of screw gear 42 with gear members 42A engaging detents 47 of ratchet body 40.

In use, a user places the portable light 20 around the user's neck and turns on the light source at each side of the user's neck by switches 30. The user may adjust each of the body members 24 with the light sources 28 up and down by ratchet member 26. Preferably, the ratchet member 26 is constructed and arranged to provide for about a 70 degree angle of rotation and five different fixed positions. It is understood, however, that ratchet members 26 may not include gear member 42A and detents 47 and allow for smooth movement of body member 24 without any fixed position.

Referring to FIGS. 9-16, there is shown another embodiment of portable light 120. The portable light 120 includes a neck member 122, body members 124, ratchet members 126, light sources 128, and a switch 130. Light 120 further includes a power assembly 132 which includes a power supply, e.g. a rechargeable battery 142, a charging port 143 and a charge indicator 156. The portable light 120 will now be discussed in further detail.

Figure 15:
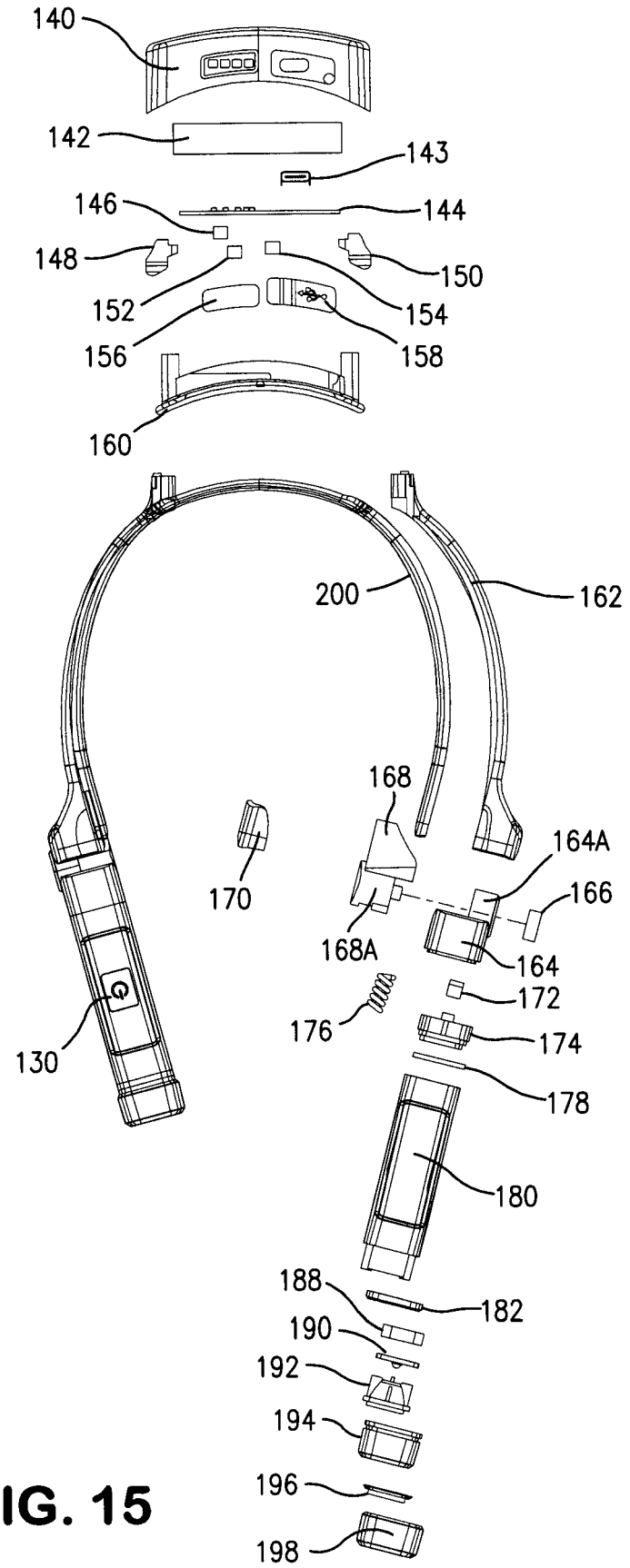
FIG. 15 is an exploded view of the portable light of FIG. 9.

Referring to FIG. 15, there is shown an exploded view of the portable light 120 and includes components of the portable light 120 as follows:

#140 Battery Cover
#142 Battery
#143 Socket Type USB-C
#144 LED PCB
#146 Socket Port 1

#148 Waterproof Wire Anchor 1
#150 Waterproof Wire Anchor 2
#152 Socket Port 2
#154 Socket Port 3
#156 Lens Indicator
#158 USB Cover
#160 Battery Anchor Plate
#162 Outer Neck Piece
#164 Body Member Body End (left tail)
#166 Ratchet Screw Cover
#168 Ratchet Member Body (Gear Cap)(with detents)
#170 Ratchet Member Gear Cap Cover
#172 Ratchet Member Detent Stop
#174 Connector For Body End
#176 Detent Stop Spring
#178 O-Ring
#180 Body Member Body
#182 Red Ring
#188 Heat Sink
#190 LED PCB
#192 Reflector
#194 Lens Body
#196 Lens
#198 Lens Cap
#200 Inner Neck Piece The various components of the portable light 120 will now be discussed in further detail. Similar to portable light 20, neck member 122 fits around a user's neck and may rest on the shirt collar of the user or fit comfortably around the neck of the user. The neck member of the portable light may be flexible, made of ABS plastic, allowing the portable neck light to be pulled outward when placing the light around a user's neck and may contract once on a user's neck to rest snuggly and comfortably on the user's neck. One of body members 124 includes an on/off switch 130. Body members 124 include the lighting components. The body 124 is a molded ABS plastic and includes a body 180, body end 164 attached to body 180 by connector 174, lens body 194 and lens cap 198 providing for an integral body 124. Body 124 includes the lighting components including an LED PCB light source 190, lens 196, reflector 192, heat sink 188 and ring 182 (colored red for aesthetics). The switch 130 operating the light components in body members 124 may provide for two or more operating modes, e.g. on/off; or with high and low illumination and off; or on with multiple degrees of illumination and off. The lighting components in body 124 are connected to the power assembly 132 by a wire (not shown) running from the power assembly (through wire anchors 148 and 150) through the inside of outer neck piece 162 and covered by inner neck piece 200.

Figure 16:
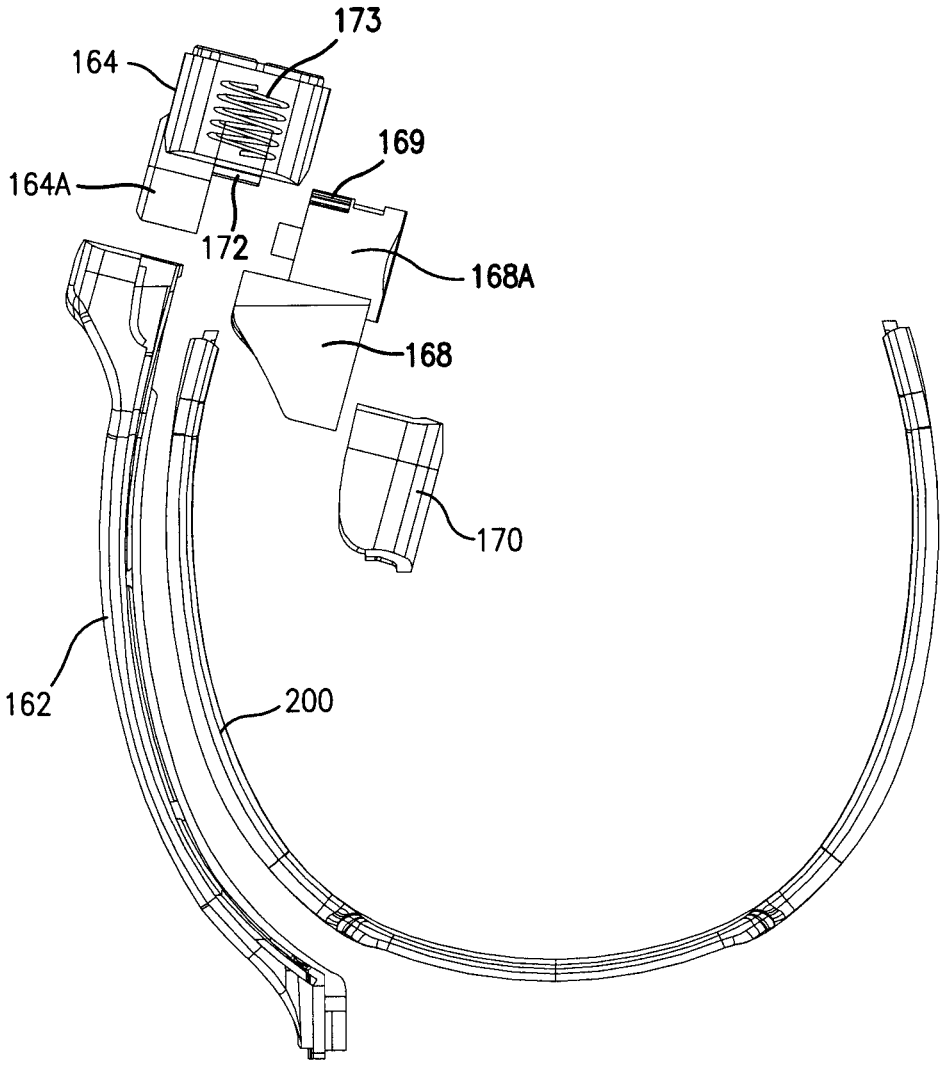
FIG. 16 shows the light components with respect to the ratchet member of the portable light of FIG. 9.
Figure 17:
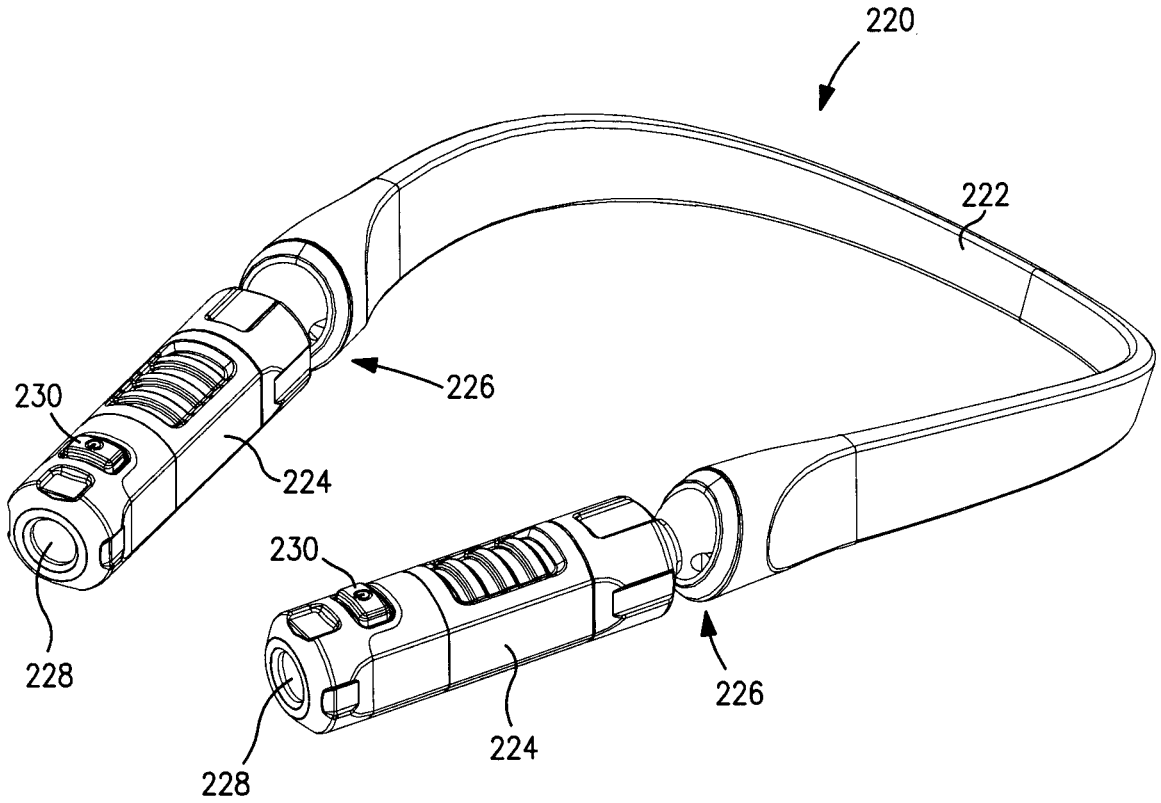
FIG. 17 is a perspective view of a third embodiment of the portable light.
Figure 19:
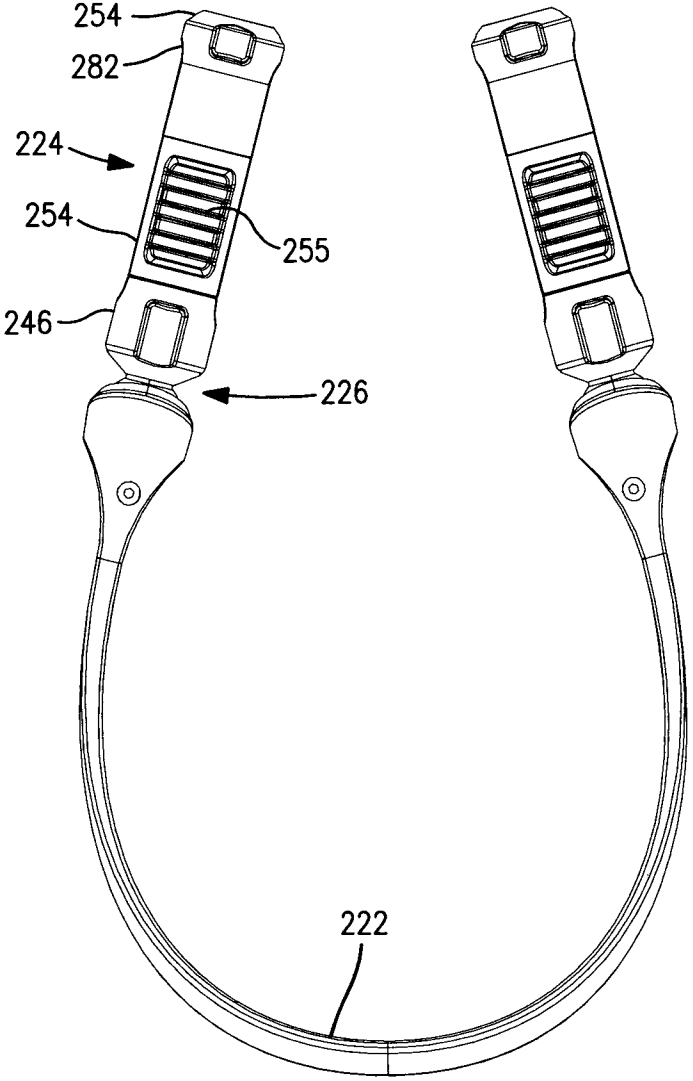
FIG. 19 is a bottom view of the portable light of FIG. 17.
Figure 18:
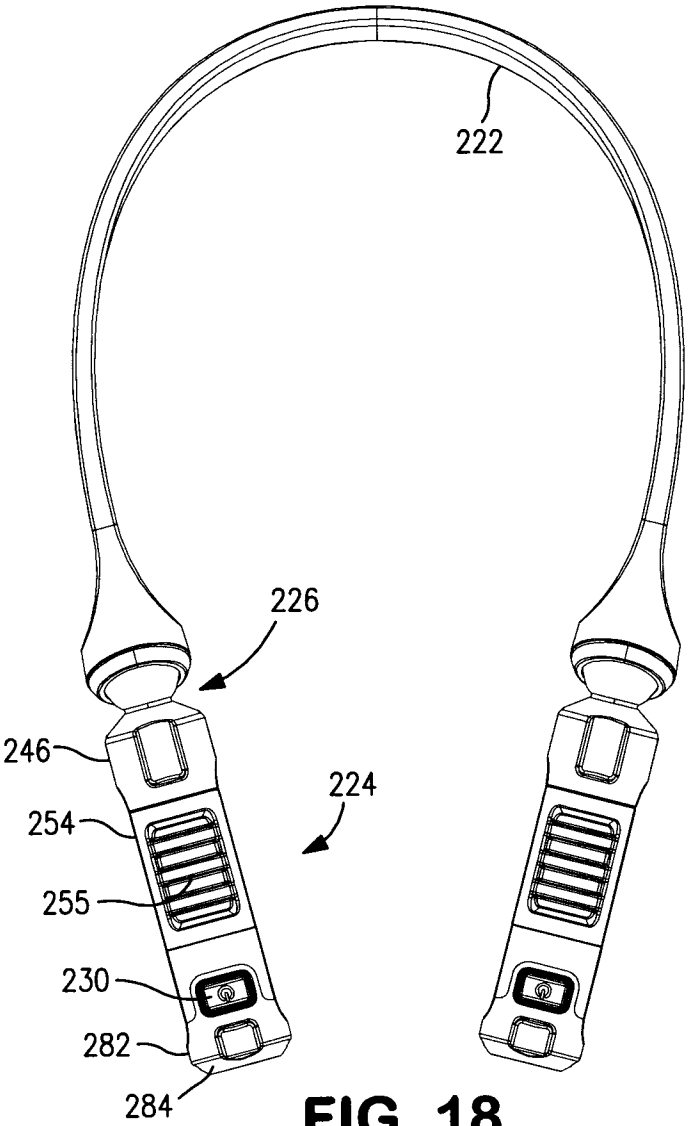
FIG. 18 is a top view of the portable light of FIG. 17.
Figure 22:
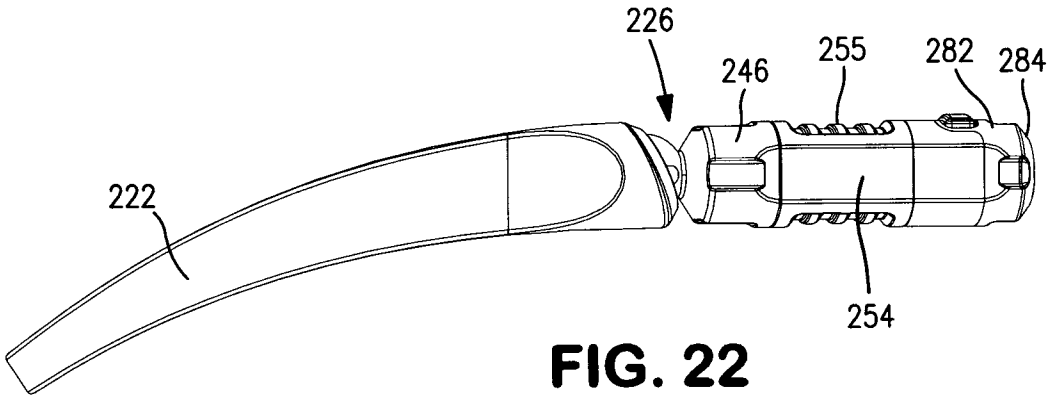
FIG. 22 is a side view of the portable light of FIG. 17.
Figure 20:
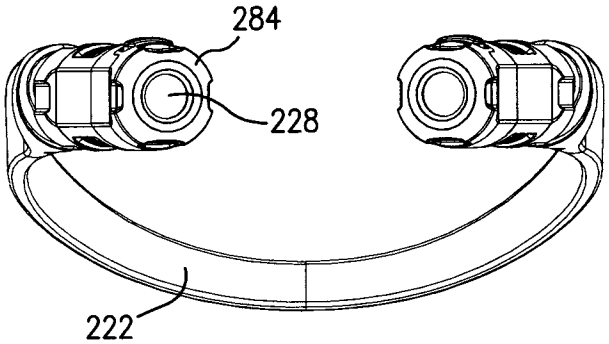
FIG. 20 is a front view of the portable light of FIG. 17.
Figure 21:
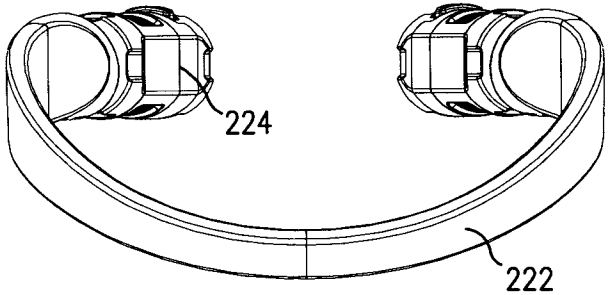
FIG. 21 is a rear view of the portable light of FIG. 17.

As seen in FIGS. 15 and 16, neck piece 122 comprises an outer neck member 162 and an inner neck member 200. The outer neck piece is preferably ABS plastic and the inner neck piece is preferably a resilient rubber material. The neck member 122 includes a power assembly 132 which includes a housing 140. The housing 140 includes a back cover and battery anchor plate 160, a USB cover 158 (preferably a resilient water proof material) and charge indicator lens 156. Inside housing 140 is a power source such as a rechargeable battery 142; an LED PCB 144 with socket ports 146, 152 and 154; and a socket type USB-C 143 under USB cover 158. The battery is charged by a battery charger (not shown) inserted into socket 143 under cover 158 and connected to a standard 120V AC power source.

Figure 9:
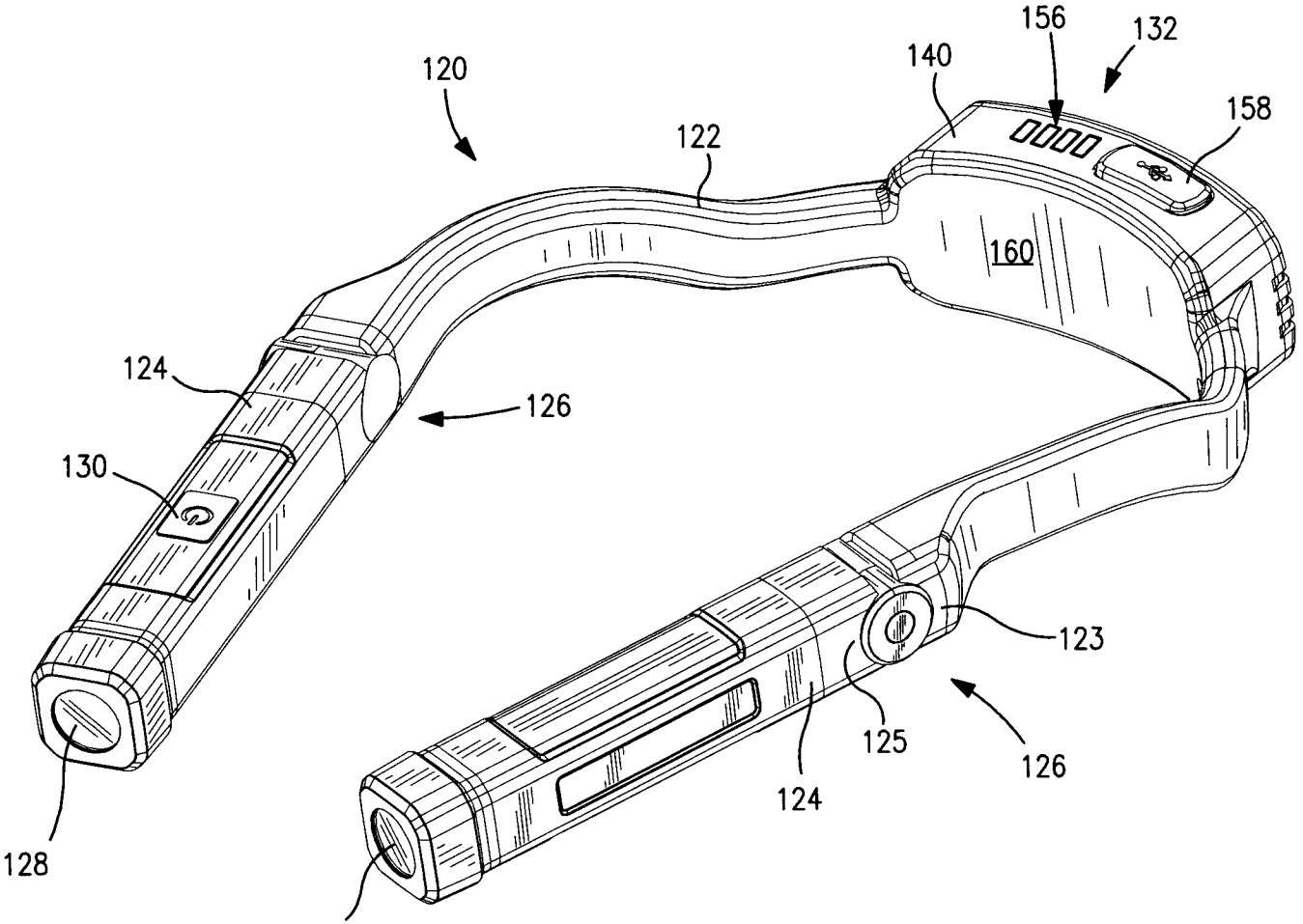
FIG. 9 is a perspective view of a second embodiment of the portable light.
Figure 11:
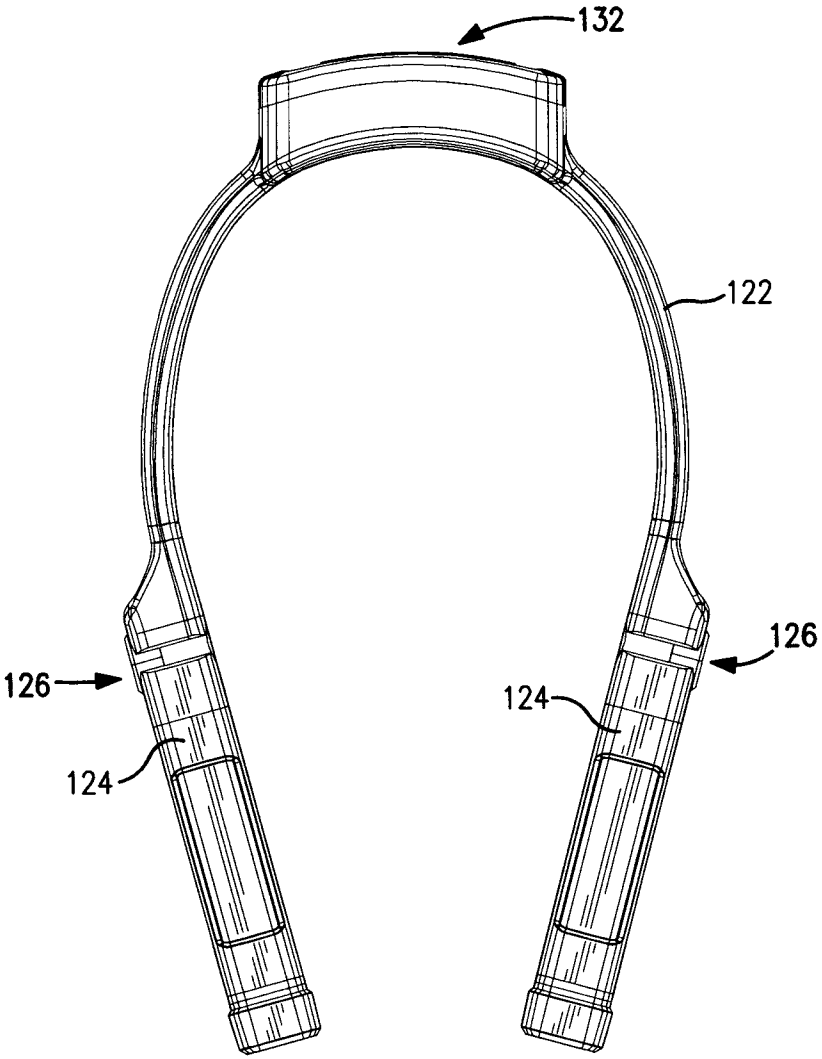
FIG. 11 is a bottom view of the portable light of FIG. 9.
Figure 10:
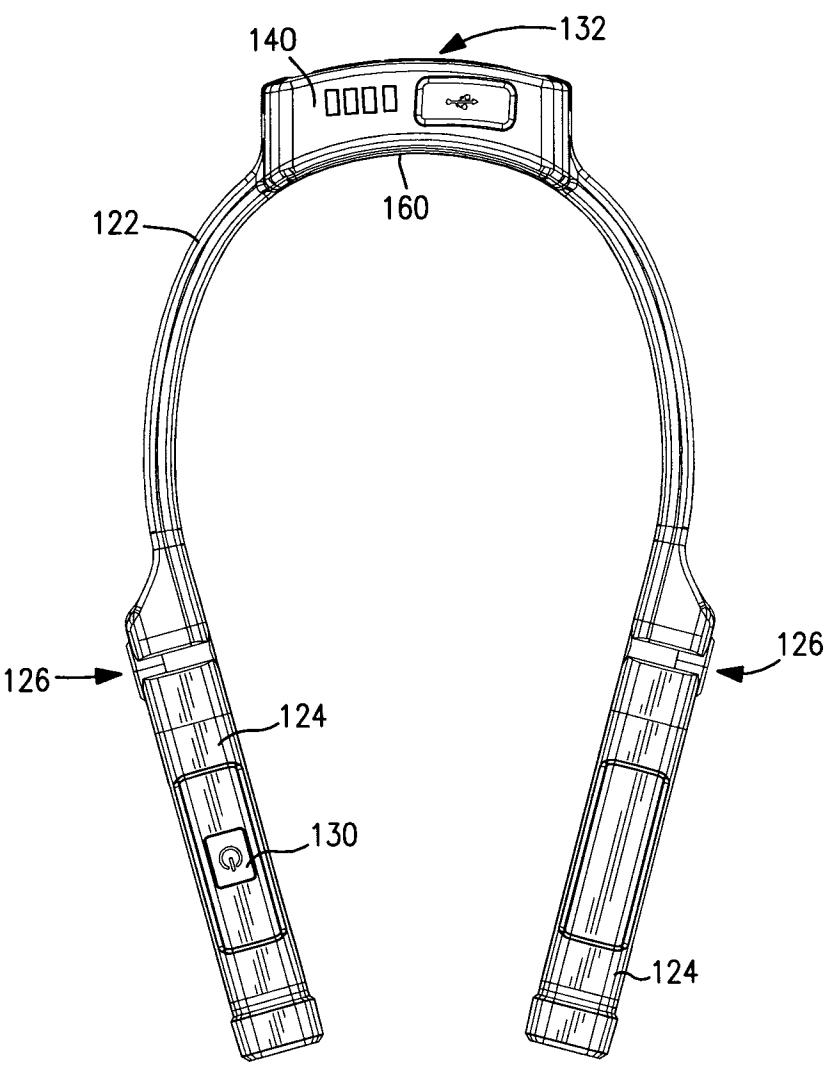
FIG. 10 is a top view of the portable light of FIG. 9.
Figure 14:
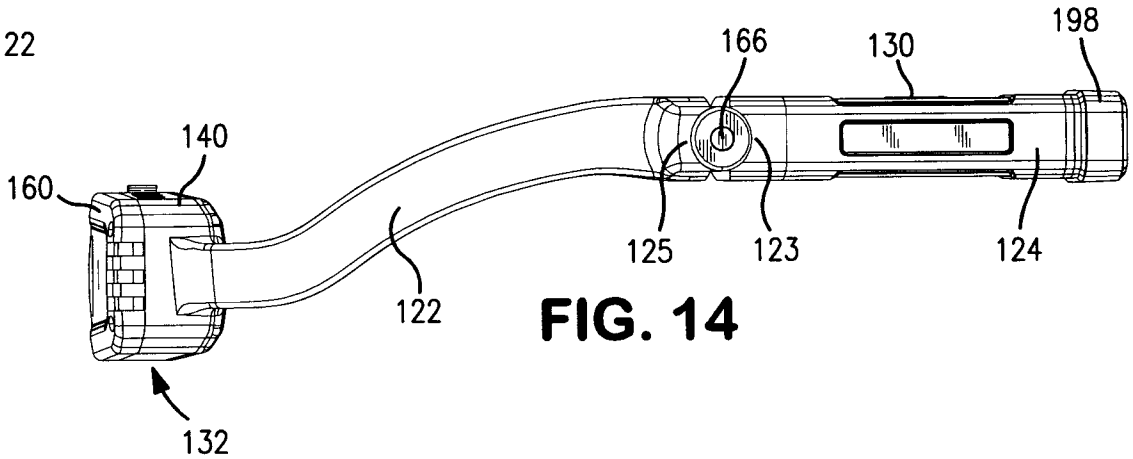
FIG. 14 is a side view of the portable light of FIG. 9.
Figure 12:
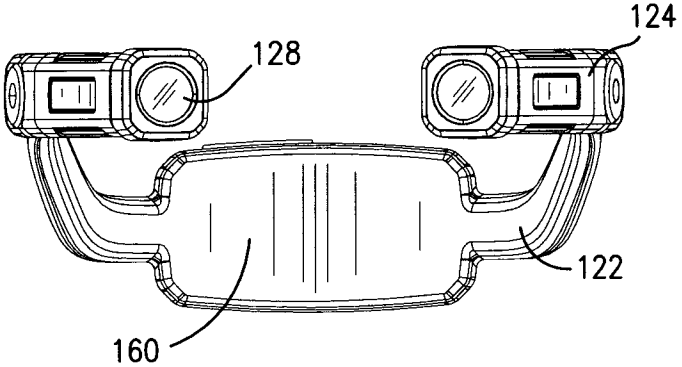
FIG. 12 is a front view of the portable light of FIG. 9.
Figure 13:
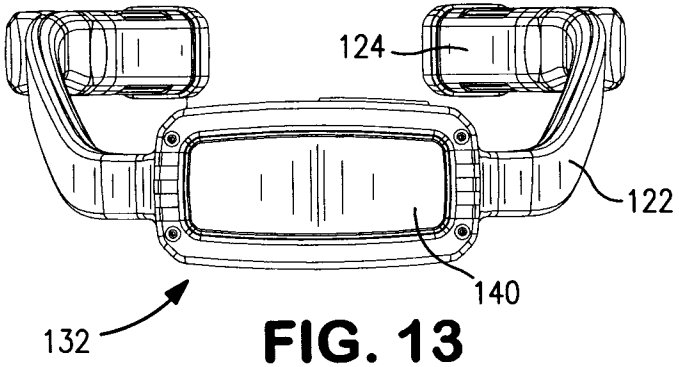
FIG. 13 is a rear view of the portable light of FIG. 9.

Referring, for example, to FIGS. 9, 15 and 16, the ratchet member 126 includes a ratchet body 168 which mates with body end 164, and which is between neck member 122 and body member 124 and is generally cylindrical in shape. Neck member 122 with ratchet body 168 provide for a C-shaped end piece 123 and body member 124 with body end 168 provide for a C-shaped end piece 125. The ratchet member 126 allows body member 124 to rotate up and down on neck piece 122.

The ratchet member 126 includes a gear assembly which allows the light body 124 to be adjusted up and down in relation to neck piece 122, preferably to an angle of about 70 degrees, although the invention is not limited thereto. Preferably, the ratchet member 126 comprises body end 164, ratchet body 168 with detents 169, gear cap cover 170 and detent stop 172, as shown, for example, in FIGS. 15 and 16. Members 164, 168 and 170 provide for ratchet body 126. The ratchet body 168 includes a cylindrical portion 168A and the body end 164 includes a cylindrical portion 164B which portions 168A and 164A mate to form the cylindrical shape of ratchet member 126. The body member 124 may be moved up and down in ratchet fashion with detent stop 172 fitting into detent stop spring 173 and interacting with detents 169 to provide, for example, four different fixed positions for each of body members 124. It is understood, however, that ratchet members 126 may not include detent stop 172 and detents 169 and allow for smooth movement of body member 124 without any fixed position.

In use, a user places the portable light 120 around the user's neck and turns on the light sources at each side of the user's neck by switch 130. The user may adjust each of the light sources up and down by ratchet member 126. Preferably, the ratchet member 126 is constructed and arranged to provide for about a 70 degree angle of rotation.

Referring to FIGS. 17-24, there is shown another embodiment of the portable light 220. The portable light 220 includes a neck member 222, body members 224, ball joint members 226, light sources 228 and switches 230. The light of this embodiment is substantially similar to portable lights 20 and 120 with the exception of using a ball joint member 226 to move the body members 224 up and down and a portion of the body members 224 are removable from neck piece 222 to provide two hand held portable lights. The portable light 220 will now be discussed in further detail.

Figure 23:
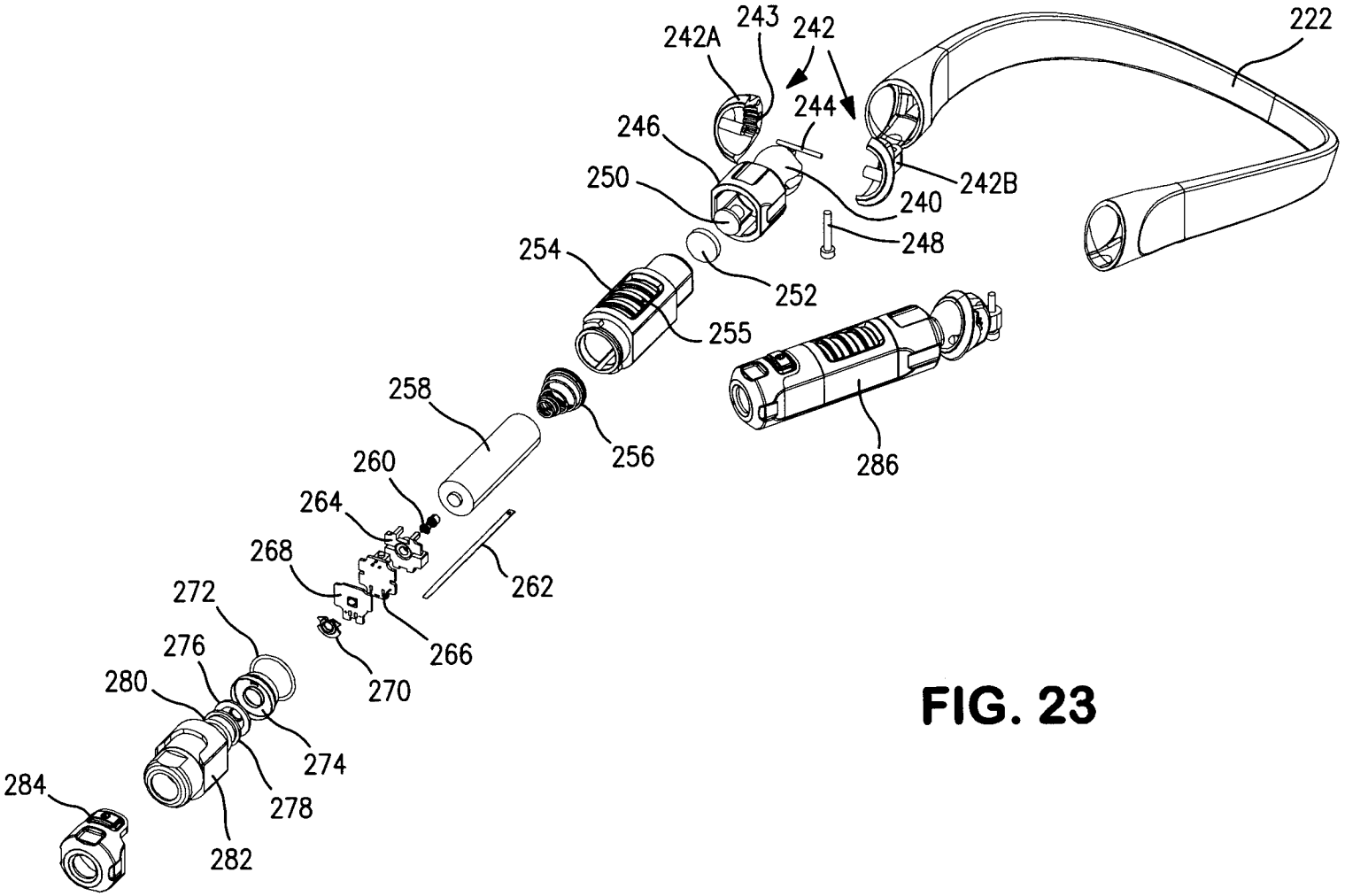
FIG. 23 is an exploded view of the portable light of FIG. 17.
Figure 24A:
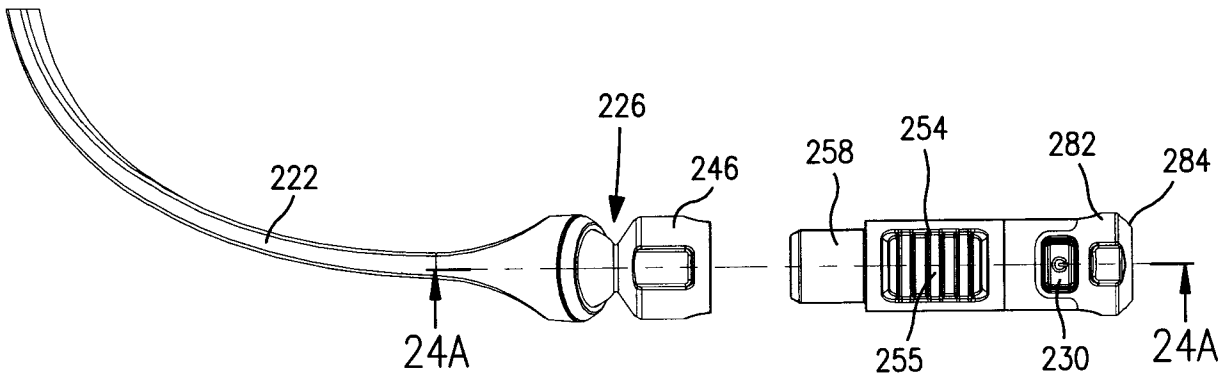
FIG. 24A shows the light components with respect to the ball joint member of the portable light of FIG. 17.
Figure 24B:
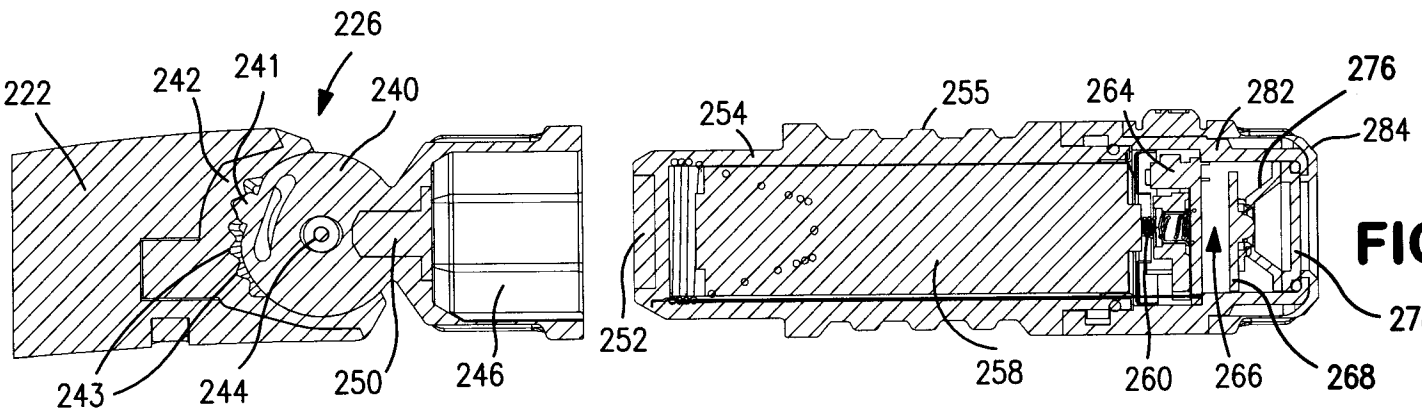
FIG. 24B is a cross-section taken along line 24A-24A of FIG. 24A showing a detailed enlarged view of the neck piece, the ball joint member and the removable body member.
Figure 24C:
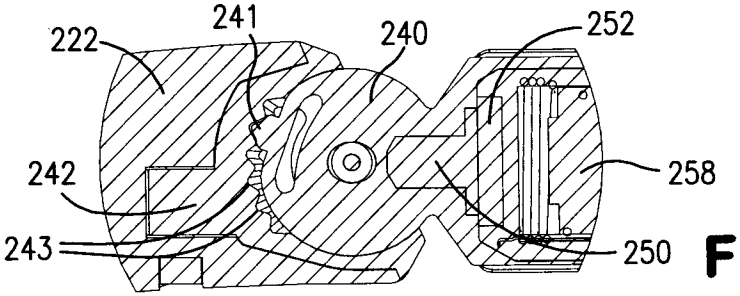
FIG. 24C is a detailed enlarged view of the ball joint member of the portable light of FIG. 17.

Referring to FIG. 23, there is shown an exploded view of the portable light 220 and includes components of the portable light 220 as follows:

#222 Neck Piece
#240 Ball Member
#242 Ball Joint Socket
#242A Ball Joint Socket Housing
#242B Ball Joint Socket Housing
#244 Socket Pin (optional)
#246 Body End
#248 Hex Screw
#250 Steel Plug
#252 Magnet
#254 Body Member Main Housing
#256 Battery Spring
#258 Battery
#260 Contact A and Contact Spring
#262 Battery Bus Bar
#264 Contact Housing
#266 PCB and Button
#268 LED
#270 LED Bezel
#272 Gasket A
#274 Contact B
#276 Reflector
#278 Lens Cover

#280 Gasket B

#282 Body Member Front Housing

#284 Body Member Front Housing Overmold and Button

#286 Left Side (240-284 substantially the same)

The various components of the portable light 220 will now be discussed in further detail. Like portable lights 20 and 120, neck member 222 fits around a user's neck and may rest on the shirt collar of the user or fit comfortably around the neck of the user. The neck member of the portable light may be flexible, made of ABS plastic, allowing the portable neck light to be pulled outward when placing the light around a user's neck and may contract once on a user's neck to rest snuggly and comfortably on the user's neck. The body member 224 includes an on/off switch 230 and the lighting components. The body 224 is a molded ABS plastic and includes a main housing 254, a front body 282 with overmold and button 284 and body end 246 providing for an integral body 224. Like portable light 20, the top and bottom of main housing 254 may include ribs 255. Body 224 includes a body end piece 246 upon which the main housing portion 254 of the body 224 may rotate by a tongue and groove locking member to access the battery 258. Inside body 224 are power source, e.g. an alkaline battery 258, operating components and a printed circuit board (PCB) 266. Body 224 further includes the lighting components including an LED PCB light source 268, LED bezel 270, lens cover 278, reflector 276, battery spring 256, contact A and contact spring 260, battery bus bar 262, contact housing 264, contact B 274 and gasket B 280. The switch 230 and operating components may provide for two or more operating modes, e.g. on/off; or with high and low illumination and off; or on with multiple degrees of illumination and off.

Referring, for example, to FIGS. 17, 23 and 24A-24C, the ball joint member 226 comprises a ball member 240 and ball joint socket 242. Ball member 240 is integral with body end 246. Socket member 242 fits into neck member 222 and mates with ball member 240 and body end 246. The ball joint 226 allows body member 224 to rotate up and down on neck piece 222 for the user to focus the light source.

The ball joint member 226 includes a ball joint assembly which allows the light body 224 to be adjusted up and down, preferably to an angle of about 70 degrees, although the invention is not limited thereto. Preferably, the ball joint member 226 comprises a ball member 240 and which is part of light body member 246. The ball member 240 includes a detent stop 241. Neck band 222 includes a socket member 242 for receiving ball member 240. Socket member 242 includes multiple detents 243 for engaging detent stop 241. The ball and socket member will allow movement of body member 224 up and down to focus the light from light source 228 and provide for a number of fixed positions. It is understood that ball joint 226 may not include detent stop 241 and detents 243 and allow for smooth movement of body member 224 without any fixed positions.

An additional feature of portable light 220 is that a portion of body member 224 may be removable from the portable light 220 to function as a separate hand held portable light. Specifically, main body housing 254 includes a magnet 252. Magnet 252 engages steel plug 250 in the base of body end 246 and holds main housing member 254 in place on portable light 220. A user may remove main housing 254 from body end 246 by gripping the housing member 254 and pulling it from body end 246, the degree of force necessary to remove the light is dependent on the strength of magnet.

In use, a user places the portable light 220 around the user's neck and turns on the light source at each side of the user's neck by switches 230. The user may adjust each of the light sources up and down by ball joint member 226. Preferably, the ball joint member 226 is constructed and arranged to provide for about a 70 degree angle of rotation. It is understood that ball joint member 226 may be used with portable light 120 in place of ratchet member 126, including providing a detached portable light. As stated above, the light source may be removed from the portable light to provide a hand held portable light.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A portable neck light for wearing on a person comprising a neck member adapted to fit around the person's neck by flexing but is sufficiently, resilient so as not to be bendable and having a first end and second end, a first body member having a light source attached at the first end of said neck member, a second body member having a light source attached at the second end of said neck member, a first member constructed and arranged between said first end of said neck member and said first body member and adapted to allow said first body member to move up and down, and a second member constructed and arranged between said second end of said neck member and said second body member and adapted to allow said second body member to move up and down, a power source and at least one switch adapted to turn said light sources on and off.

2. The portable neck light of claim 1 wherein said first and second members are constructed and arranged to allow said body members to be moved to a plurality of fixed positions.

3. The portable neck light of claim 2 wherein said first and second members are selected from the group consisting of a ratchet member and a ball joint member.

4. The portable neck light of claim 2 wherein said first and second members comprise ratchet members having a detent member and a detent stop member adapted to provide for ratchet movement.

5. The portable neck light of claim 2 wherein said first and second members comprise ratchet members having a screw gear member and a detent stop member adapted to provide for ratchet movement.

6. The portable neck light of claim 2 wherein said first and second members comprise ball joint members having a ball member and a socket member adapted to provide movement of said first and second body members.

7. The portable neck light of claim 6 wherein said ball member includes a detent stop and said socket member includes a plurality of detents adapted to provide said movement of said first and second body members to a plurality of fixed positions.

8. The portable neck light of claim 1 wherein said light sources comprise LED light sources.

9. The portable neck light of claim 1 wherein said power source comprises a rechargeable battery and having a power level indicator connected thereto.

10. The portable neck light of claim 1 wherein the up and down movement of the first and second body members in relation to the neck member is at an angle of about 70 degrees.

11. The portable light of claim 1 wherein at least one of said first and second body members is constructed and arranged to be removable from at least one of said first and second members.

12. The portable light of claim 11 wherein both of said first and second body members are constructed and arranged to be removeable from said first and second members.

13. The portable light of claim 11 wherein at least one of said first and second body members includes a magnet and one of said first and second members includes a steel plug.

14. A portable neck light for wearing on a person comprising a flexible plastic neck member adapted to fit around the person's neck by flexing but is sufficiently resilient so as not to be bendable and having a first end and second end, a first body member having a light source attached at the first end of said neck member, a second body member having a light source attached at the second end of said neck member, a power source and at least one switch adapted to turn said light sources on and off and wherein at least one of said first and second body members is constructed and arranged to be removable from at least one of said first and second ends of said neck member.

15. The portable light of claim 14 wherein both of said first and second body members are constructed and arranged to be removeable from said first and second ends of said neck member.

16. The portable light of claim 14 wherein at least one of said first and second body members includes a magnet.

17. The portable light of claim 14 further comprising a first ratchet member constructed and arranged between said first end of said neck member and said first body member and adapted to allow said first body member to move up and down to a plurality of fixed positions in relation to said first neck member, and a second ratchet member constructed and arranged between said second end of said neck member and said second body member and adapted to allow said second body member to move up and down to a plurality of fixed positions in relation to said second neck member.

18. The portable neck light of claim 17 wherein said first and second ratchet members comprise ratchet members having a detent member and a detent stop member adapted to provide for ratchet movement.

19. The portable neck light of claim 17 wherein said first and second ratchet members comprise ratchet members having a screw gear member and a detent stop member adapted to provide for ratchet movement.

20. The portable neck light of claim 14 wherein said power source comprises a rechargeable battery and having a power level indicator connected thereto.

* * * * *